United States Patent [19]

Schwarzschild et al.

[11] 4,055,945

[45] Nov. 1, 1977

[54] FREQUENCY ADJUSTMENT MEANS FOR AN ELECTRONIC TIMEPIECE

[75] Inventors: Jack Schwarzschild; John R. Lowdenslager, both of Stamford, Conn.

[73] Assignee: Timex Corporation, Waterbury, Conn.

[21] Appl. No.: 640,665

[22] Filed: Dec. 15, 1975

[51] Int. Cl.[2] ..... G04B 27/08

[52] U.S. Cl. ..... 58/85.5; 58/23 R

[58] Field of Search ..... 58/23 R, 34, 50 R, 85.5, 58/58

[56] References Cited

U.S. PATENT DOCUMENTS

| | | | |
|---|---|---|---|
| 3,733,803 | 5/1973 | Hiraga et al. | 58/34 |
| 3,745,758 | 7/1973 | Kuritz | 58/85.5 |
| 3,777,471 | 12/1973 | Koehler et al. | 58/85.5 |
| 3,800,233 | 3/1974 | Sauthier | 58/23 R |
| 3,834,152 | 9/1974 | Nishimura et al. | 58/23 R |
| 3,841,081 | 10/1974 | Komaki | 58/85.5 |
| 3,849,977 | 11/1974 | Hirose et al. | 58/34 |
| 3,866,407 | 2/1975 | Wuthrich | 58/58 |
| 3,874,162 | 4/1975 | Boxberger et al. | 58/34 |
| 3,895,486 | 7/1975 | Hammer et al. | 58/85.5 |
| 3,916,612 | 11/1975 | Morokawa et al. | 58/23 R |
| 3,931,703 | 1/1976 | Scherer et al. | 58/85.5 |

*Primary Examiner*—Robert K. Schaefer
*Assistant Examiner*—Vit W. Miska
*Attorney, Agent, or Firm*—Lawrence Hager

[57] ABSTRACT

An electronic horological instrument which includes a piezoelectric crystal oscillator and a counter such as a series of count-down circuits connected in tandem. The "effective frequency of the oscillator" is adjusted by inhibiting the oscillator pulses to the count-down circuits by means of a pulse inhibit circuit. The pulse inhibit circuit is readily programable to inhibit a desired number of oscillator pulses by means of a switch arrangement that includes multi-position detented pin switches.

1 Claim, 4 Drawing Figures

FREQUENCY ADJUSTMENT MEANS FOR AN ELECTRONIC TIMEPIECE

BACKGROUND OF THE INVENTION

The present invention relates to horology and more particularly to the frequency adjustment of an electronic watch.

In recent years great interest has been shown in using piezoelectric crystal oscillators as highly accurate time bases in horological instruments.

However, it is difficult and, therefore, expensive to produce a small piezoelectric crystal having an exact predetermined frequency. For example, an error of only 0.01% (one part in ten thousand) in the frequency results in an error of about 10 seconds a day or 5 minutes a month, which is unacceptable. This difficulty increases when the problems of mass production are considered. Highly trained workers are required to produce suitable crystals because of the small size of the crystal and the need for its exact frequency. And even when the crystal is accurately manufactured to its specified frequency, it may drift from that frequency due to the effects of age and environmental conditions. Generally, the watch repairman would not have the tools or the skill to readjust the frequency of the piezoelectric crystal.

A partial list of prior art patents of interest includes U.S. Pat. No. 3,540,207 to Keeler, U.S. Pat. No. 3,756,014 to Zatsky et al, U.S. Pat. No. 3,777,471 to Koehler et al, U.S. Pat. No. 3,914,706 to Hammer et al and U.S. Pat. No. 3,916,612 to Shigeru Morokawa et al. These prior art patents are merely typical of the art and are not in any way intended to be an all-inclusive list of pertinent prior art.

Therefore, it is an objective of the present invention to provide a system in an electronic watch in which the effective frequency of a piezo-electric crystal may be accurately adjusted to an exact predetermined frequency by activation of a plurality of switches.

It is a further objective of the present invention to provide a means for reversible and stepwise adjustment of the effective frequency of the piezoelectric crystal over a wide range of frequencies.

It is a further objective of the present invention to provide a means for reversible and stepwise adjustment of an electronic timepiece to run faster or slower to obtain accurate timekeeping by actuation of a plurality of switches.

It is a further objective of the present invention to provide a new and improved switch and circuit arrangement for adjusting the "effective frequency of the oscillator" over a wide range of frequencies.

It is a still further objective of the present invention to provide a new and improved switch and circuit arrangement for adjusting the output frequency of a count-down circuit.

SUMMARY OF THE INVENTION

A pulse inhibit circuit is controlled or programed to inhibit oscillator or count-down circuit pulses for adjustment of an electronic timepiece to run faster or slower, to obtain accurate timekeeping, by actuation of one or more of a plurality of switches. The switches are actuated until the combination of actuated and unactuated switches is obtained which results in the desired timekeeping accuracy. The programing of the pulse inhibit circuit provides a method which has the same effect as trimming the crystal, but at a lower cost, using less skilled labor, without the need for soldering, and which is stepwise and reversible over a wide frequency range. In addition, as the oscillator frequency changes with age, the watch repairman may readily readjust the timepiece without touching the crystal, without expensive equipment and without soldering, by mere activation of switches to cause the watch to run faster or slower.

Other objectives of the present invention will be apparent from the following detailed description of the preferred embodiment of the invention, taken in conjunction with the accompanying drawings wherein the same reference number is used to designate like elements throughout for ease of understanding.

In accordance with the present invention, an electronic watch is provided having a case and a source of electrical power, such as a battery cell. The watch includes a piezoelectric crystal as its time base and a counting circuit, such as a series of frequency dividing (count-down) circuits connected in tandem. The counting circuit provides an output at a predetermined and accurate rate to operate a time display, for example, a digital display.

The piezoelectric crystal is small, so that it fits within the case of the watch. The crystal is not manufactured to a final and accurate predetermined frequency, which minimizes its cost. The crystal is manufactured so that its inherent frequency is somewhat above the desired frequency. The effective frequency of the crystal is adjusted by a pulse inhibit circuit. The pulse inhibit circuit periodically inhibits the desired number of oscillator pulses by actuation of switch means which includes a plurality of manually activated detented pin switches. The detented pin switches are actuated until the proper combination of actuated switches is obtained for proper adjustment of the "effective frequency of the oscillator".

The term "effective frequency of the oscillator" as used herein describes an equivalent average frequency, $f_e$ that is defined by the rational expression, $$(f_e/P) = (f_c/(P+N)$$

where N is the number of pulses inhibited periodically, P is the number of cycles of the effective frequency during the correction period, and $f_c$ is the actual crystal frequency. Note that the proper and desired number of pulses to be inhibited makes the effective frequency most nearly equal to 32768 Hz. Thus, in accordance with the preferred embodiment of the invention, an inhibit gate or circuit is placed within the timepiece circuit to inhibit the oscillator pulses at the input stage of the count-down circuit 3. However, it should be recognized that the inhibit gate or circuit could, instead, be placed between two (flip-flop) stages of the countdown circuit without departing from the scope of the invention. Therefore, the term "at the count-down circuit" as used herein describes the inhibiting of pulse signals being effected either between the oscillator and the count-down circuit or between two (flip-flop) stages of the count-down circuit.

Figure 1:
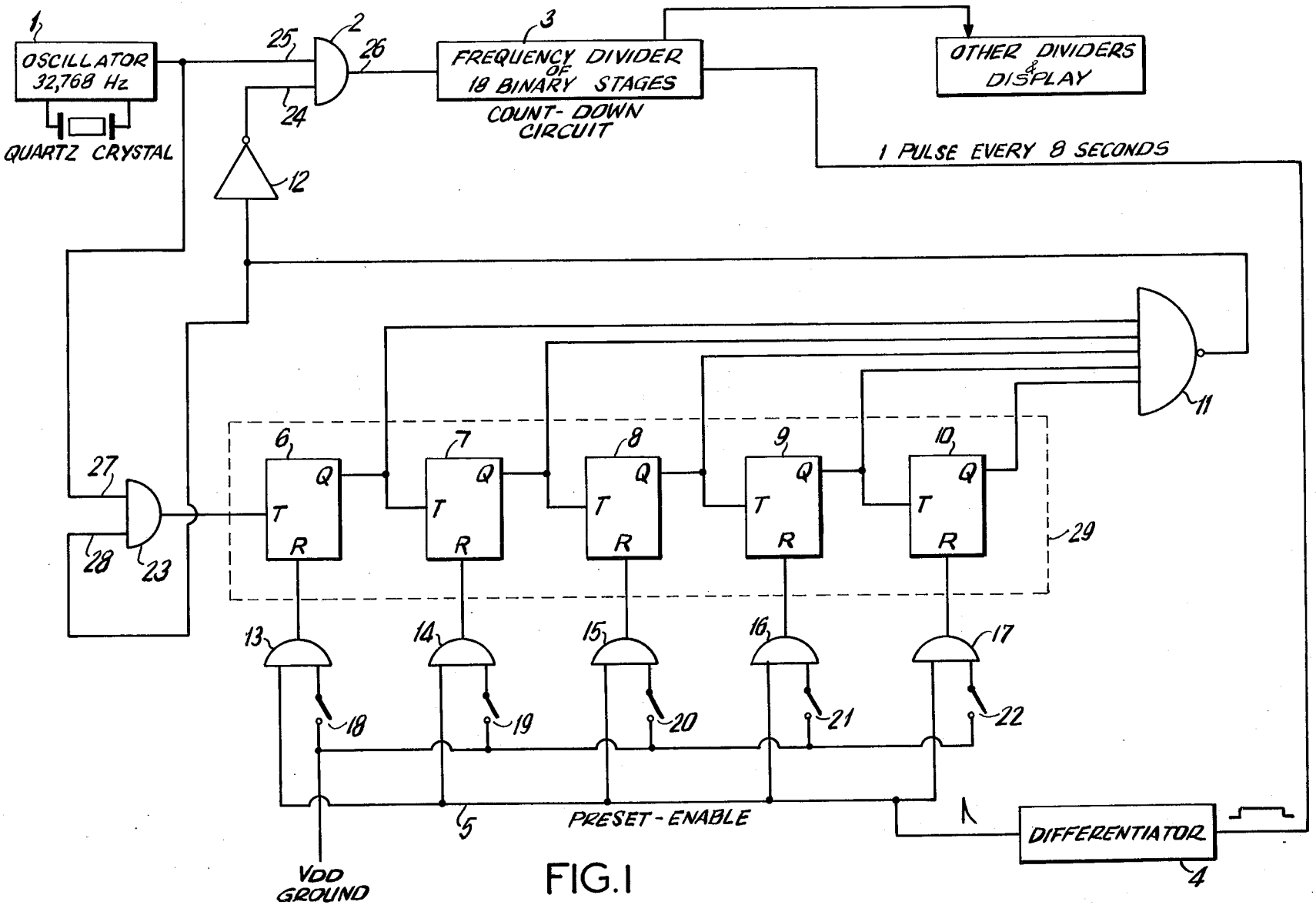
FIG. 1 is a block schematic diagram of the electronic system of an embodiment of the present invention.

Referring now to FIG. 1, the pertinent part of the solid state digital watch is shown for purposes of illustrating the preferred embodiment of the invention. The circuit includes a piezoelectric crystal oscillator 1. The crystal is, for example, a low-cost, wide-tolerance quartz crystal having an inherent frequency somewhat above the desired effective frequency. The crystal, if it is manufactured by cutting, is not finally trimmed to resonate at the desired frequency, but is left at the higher frequency. The crystal oscillator 1 is connected to a logic "AND" gate 2. The "AND" gate 2 has two inputs 24, 25. The output 26 of the "AND" gate 2 is connected to the count-down circuit 3 which comprises a plurality of flip-flop frequency divider stages. The "AND" gate 2 provides an output pulse to the count-down circuit 3 for each pulse of the oscillator 1 when an enable signal is applied to input 24 of the "AND" gate 2. Conversely, if an inhibit signal, for example, a logic "0", is applied to input 24 of "AND" gate 2, the oscillator pulses are prevented or inhibited from being applied to the count-down circuit 3. Therefore, the "effective frequency of the oscillator" can be trimmed or adjusted by periodically disabling "AND" gate 2 for an appropriate number of oscillator pulses so that the effective oscillator pulse frequency to or at the count-down circuit 3 is adjusted to effect accurate timekeeping.

The "AND" gate 2 is disabled by an inhibit signal to input 24. Input 24 is connected to the output of a logic inverter gate 12. The input of the inverter gate 12 is connected to a five input "NAND" gate 11. Each input of the "NAND" gate 11 is connected to a Q output of a flip-flop 6 thru 10. The flip-flops are connected, for example, in tandem to form a counter 29 which is caused to toggle in counter-like fashion by pulses from the "AND" gate 23. The "AND" gate 23 has a first input 27 connected to the output of the oscillator and a second input 28 coupled to the output of "NAND" gate 11. Each output of the logic "AND" gates 13 thru 17 are connected to a reset input of the flip-flops 6 thru 10. Each logic "AND" gate 13 thru 17 has two inputs, one of which is connected to a differentiator 4 and the other being connected through a switch 18 thru 22 to a voltage potential, for example, $V_{DD}$.

In operation, the number of pulses to be deleted is determined by closing an appropriate switch or switches. The switches 18 thru 22 cover or control the total number of pulses which can be deleted, in binary fashion. For example, closing switch 18 deletes or inhibits one pulse of the 32,768 Hz (nominal) crystal oscillator frequency in every 8 second interval, resulting in a frequency decrease of 1 out of $8 \times 32{,}768$ pulses or approximately 4 ppm (parts per million). Closing switch 19 causes elimination or inhibiting of 2 pulses every 8 seconds ($\Delta f = 8$ ppm). And closing switch 20 inhibits 4 pulses every 8 seconds ($\Delta f = 16$ ppm) etc.. closing two or more switches results in the inhibiting of the sum of the respective switch inhibiting pulse counts. Thus, by appropriate combination of the five illustrated switches 18 thru 22, a range of frequency adjustment of $(2^5 - 1) \times 4 = 124$ ppm can be covered in steps of 4 ppm, with the maximum error in the output frequency limited to $\pm 2$ ppm. Therefore, the term "respective and predetermined number of pulse signals" as used herein describes a selected number of pulse signals to be inhibited during each periodic period, for example, each 8 second interval, with activation of a selected switch.

The oscillator 1 is coupled through "AND" gate 2 to the count-down circuit 3. An appropriate output from a stage of the count-down circuit 3, for example, 1 pulse every 8 seconds, is coupled to a differentiator 4, which in response thereto provides a sharp pulse to the preset-enable line 5 and, therefore, to an input of each of the "AND" gates 13 thru 17. Each of the Q outputs of the five flip-flops 6 thru 10 are connected to an input of a five input "NAND" gate 11. With all the switches 18 thru 22 open, all reset inputs R to the flip-flops 6 thru 10 are low. In this state, it can be assumed that the Q outputs of each of the flip-flops 6 thru 10 are high, i.e., at a logic "1" state, and, therefore, the output of "NAND" gate 11 is low. The low or logic "0" output of "NAND" gate 11 is inverted to a high or logic "1" by inverter 12. The high output of inverter 12 is coupled to the input 24 of "AND" gate 2 and represents an enable signal at this input 24. In this condition, each oscillator pulse output at input 25 will enable "AND" gate 2 and result in a corresponding pulse input to the count-down circuit 3. At the same time gate 23 is disabled by the low on its input 28 and, therefore, prevents or inhibits toggle pulses to the T inputs of the counter 29.

Closing, for example, switches 18 and 19 causes the R inputs of the flip-flops 6 and 7 to go high with each pulse on the preset-enable line 5 from the differentiator 4. The corresponding Q output will go to a low or logic "0" causing the output of "NAND" gate 11 to go high. This high output of "NAND" gate 11 enables "AND" gate 23 to provide an output signal with each oscillator pulse on its input 27 and disables "AND" gate 2, i.e., causes a low or inhibit signal at input 24. After three oscillator pulses to input 27 and, therefore, three toggle pulses to the counter 29, the Q outputs are toggled or clocked to a high or logic "1" resulting in an enable signal to input 24 of "AND" gate 2. In this manner, three oscillator pulses are inhibited which results in a lowering of the "effective frequency of the oscillator" to the count-down circuit 3. The input 24 of "AND" gate 2 remains at the enable signal state until the next 8 second pulse to the differentiator 4. Thus 3 pulses are periodically inhibited during each 8 second interval which is the equivalent to a frequency adjustment of 12 ppm.

Figure 2:
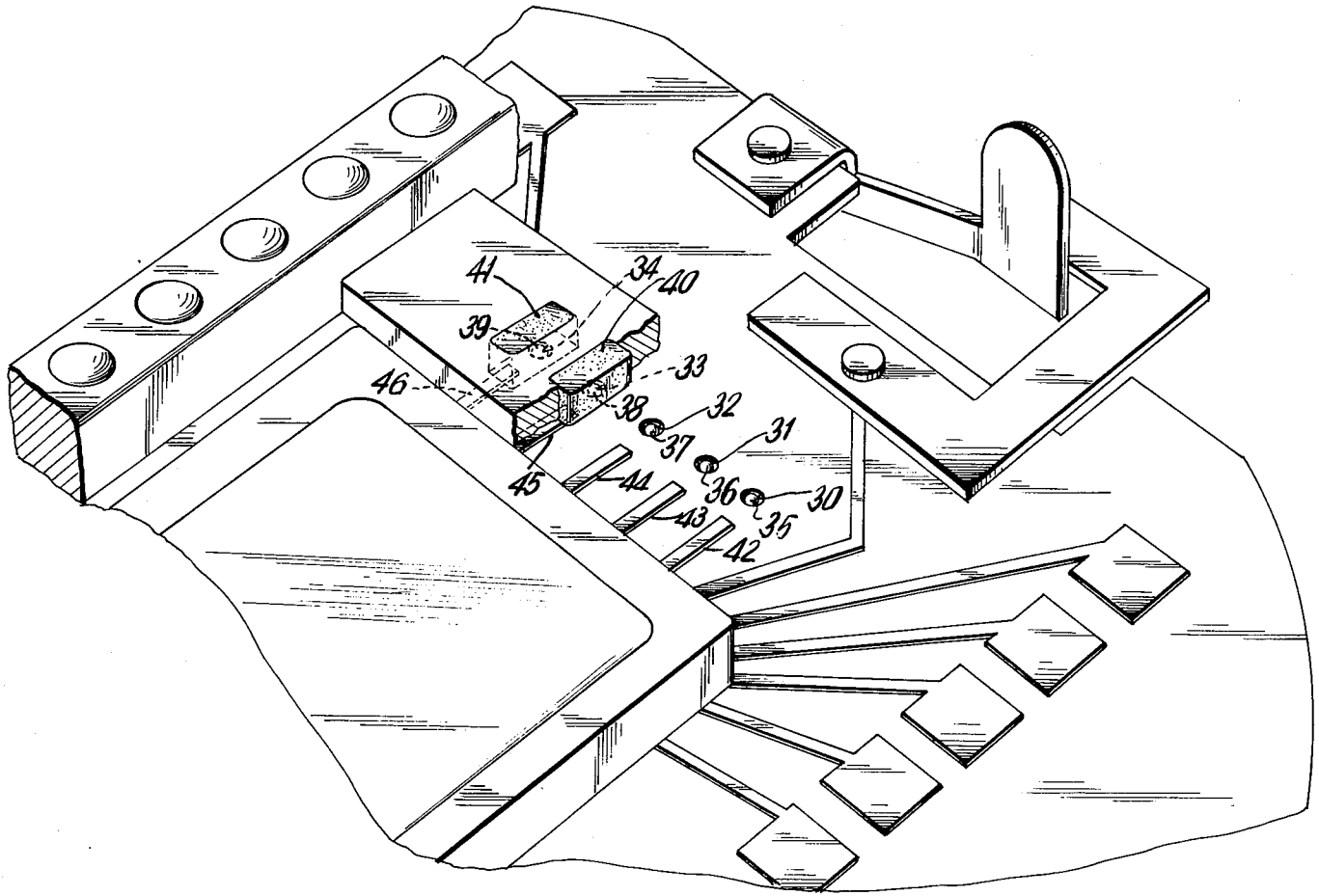
FIG. 2 is a top plan view, partly cutaway, of a watch substrate board having mounted thereon integrated circuit connectors.
Figure 3:
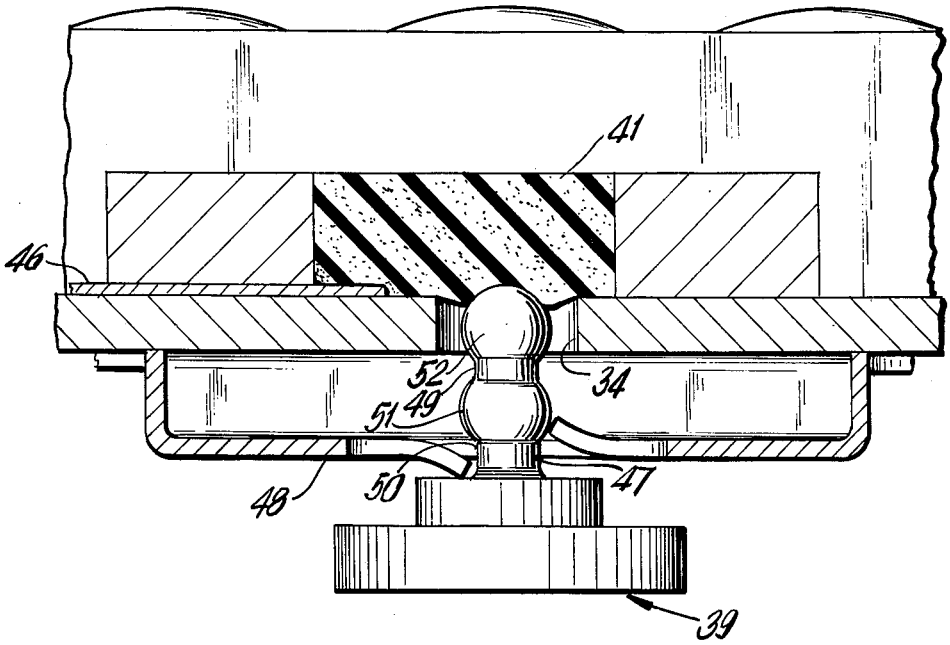
FIG. 3 is a side view of a detented pin switch in accordance with the present invention.
Figure 4:
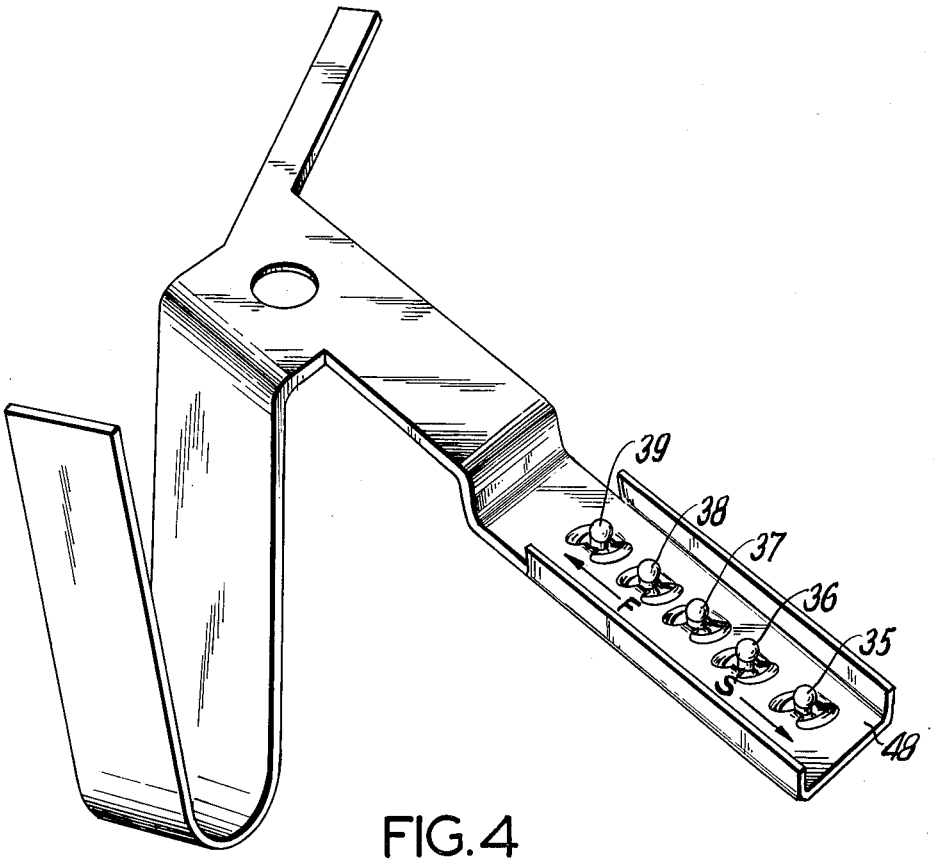
FIG. 4 is a top plan view of a spring energy cell connector having a plurality of detented pin switches mounted thereon in accordance with the present invention.

Reference will now be made to FIGS. 2, 3 and 4 which show the switch arrangement according to the present invention. Through-holes 30 thru 34 are provided in the substrate board into which detented pins 35 thru 39 are inserted. Five conductive, for example, rubber pads, only two of which are shown 40 and 41, are connected or bonded on the substrate board such that each pad or insert 40, 41 overlaps or covers a through-hole. Electrical connection between the pulse inhibit circuit on the integrated circuit chip, and a pad, for example, 40 and 41, is made by means of a conductive connector 42 thru 46. As seen in FIG. 3, the detented pin 39 includes a shaft 47 which is aligned with the through-hole 34 of the substrate board and is held in position by a spring mounting means 48. The shaft 47 includes intermediate contoured portions 49, 50, 51 and 52 which are engaged by the spring mounting means 48 to lock the pin or shaft 47 in various positions. When the detented pin is pushed inwardly as shown in FIG. 3, the detented pin makes contact with the conductive rubber pad 34. The detented pins 35 thru 39 are held in a detent position by the spring mounting means 48 and are in electrical contact therewith. The spring mounting means 48 is electrically connected to a source of voltage potential such as the positive or negative terminal of the battery. In this manner, for example, with the spring mounting means 48 connected to the battery positive terminal (not shown) and with the detented pin 39 pushed inwardly as shown in FIG. 3, electrical connection between the pulse inhibit circuit and the source of voltage potential is completed via the spring mounting means 48, the detented pin 39, the conductive pad 34 and connector 46. Thus, assuming detented pin 39 represents the actuator of switch 18 as shown in FIG. 1, the battery voltage $V_{DD}$ is provided to the input of "AND" gate 13 causing, in cooperation with the differentiator 4, periodic inhibiting of the oscillator pulses.

While the invention has been described with respect to a preferred embodiment, it should be apparent to those skilled in the art that numerous modifications may be made thereto without departing from the spirit and scope of the invention.

What is claimed is:

1. A horological instrument comprising:

a piezoelectric crystal oscillator;

a countdown circuit coupled to the oscillator to receive pulse signals from said oscillator and frequency divide said pulse signal down to a lower frequency output pulse signal;

means for periodically inhibiting at the countdown circuit at least a first or second predetermined number of pulse signals or the sum of the first and second predetermined number of pulse signals to further lower the frequency of the output pulse signal at said countdown circuit;

means including at least a first and second manually activatable switch each having an elongated shaft actuator having contoured portions to establish a first and second detented longitudinal tactile positions, a switch contact mounted for selective engagement with the shaft actuator, and single spring means common to said first and second manually activatable switches and having spring fingers in an arm of an energy cell spring in electrical contact with the shaft of each of said first and second manually activatable switches and engaging each shaft for providing detented longitudinal movement of each shaft to selectively enable a fixed engagement in the first detented longitudinal tactile position with the switch contact wherein electrical connection is maintained between the spring means and the shafts and the switch contact and a fixed disengagement with the switch contact in the second detented longitudinal tactile position, said first switch being activated to control said means for periodically inhibiting pulse signals to inhibit the first predetermined number of pulse signals and deactivated to cease inhibiting the first predetermined number of pulse signals, said second switch being activated to control said means for periodically inhibiting pulse signals to inhibit the second predetermined number of pulse signals and deactivated to cease inhibiting the second predetermined number of pulse signals, and first and second switches both being activated to control said means for periodically inhibiting pulse signals to periodically inhibit the sum of the first and second predetermined number of pulse signals and;

time indicating means coupled to the countdown circuit to be activated thereby.

* * * * *